United States Patent [19]

Kelly

[11] Patent Number: 5,062,199

[45] Date of Patent: Nov. 5, 1991

[54] APPARATUS FOR RADIALLY EXPANDING AND ANCHORING SLEEVES WITHIN TUBES

[75] Inventor: John W. Kelly, La Canada, Calif.

[73] Assignee: Haskel, Inc., Burbank, Calif.

[21] Appl. No.: 637,156

[22] Filed: Jan. 3, 1991

Related U.S. Application Data

[62] Division of Ser. No. 463,367, Jan. 11, 1990, Pat. No. 5,009,002.

[51] Int. Cl.[5] ..... B23P 15/26

[52] U.S. Cl. ..... 29/727; 29/402.09; 29/523; 29/890.031; 29/890.036

[58] Field of Search ..... 29/890.031, 890.036, 29/523, 234, 727, 402.09; 72/58, 60, 61, 62; 269/48.1, 22

[56] References Cited

U.S. PATENT DOCUMENTS

| | | | |
|---|---|---|---|
| 4,393,564 | 7/1983 | Martin | 29/890.031 |
| 4,450,612 | 5/1984 | Kelly | 72/62 |
| 4,567,631 | 2/1986 | Kelly | 29/523 |
| 4,607,426 | 8/1986 | Kelly | 29/727 |
| 4,635,333 | 1/1987 | Finch | 72/58 |
| 4,649,493 | 3/1987 | Castner et al. | 72/58 |
| 4,761,981 | 8/1988 | Kelly | 72/58 |
| 4,793,044 | 12/1988 | Cartry et al. | 29/890.036 |
| 4,827,594 | 5/1989 | Cartry et al. | 29/523 |
| 4,847,967 | 7/1989 | Gauden | 29/523 |
| 4,937,933 | 7/1990 | Dietrich | 29/726 |

*Primary Examiner*—Irene Cuda

[57] ABSTRACT

A method and apparatus for radially expanding and anchoring a sleeve within a tube are provided. The apparatus includes a hydraulic expanding mandrel, a fluid source for supplying a first pressurized fluid and a second fluid to first and second pumps and a fluid control mechanism for selectively activating the second pump and for controlling the total volume of pressurized fluid discharged by the second pump. In order to radially expand and anchor the sleeve within the tube, the sleeve is first inserted within the tube. Then, the mandrel is inserted within the sleeve such that the mandrel and sleeve together define a substantially annular hydraulic pressure zone situated between the sleeve, the body of the mandrel and the seals. Thereafter, a first supply of pressurized fluid, which can be pressurized by the first pump, is introduced into the pressure zone through the passage until the first supply reaches a predetermined pressure is reached which is above the radial yield point of the sleeve but below the aforementioned aggregate yield point. Then, a predetermined aggregate volume of a second supply of pressurized fluid, which can be pressurized by the second pump as controlled by the fluid control mechanism, is introduced into the pressure zone through the passage at a maximum predetermined pressure which is above the aforementioned aggregate yield point.

15 Claims, 3 Drawing Sheets

APPARATUS FOR RADIALLY EXPANDING AND ANCHORING SLEEVES WITHIN TUBES

This is a division, of application Ser. No. 07/463,367, filed Jan. 11, 1990, now U.S. Pat. No. 5,009,002.

FIELD OF THE INVENTION

The present invention relates to a method and apparatus for radially expanding and anchoring protective sleeves within tubes contained within a tube sheet or other surrounding structure so as to effectively repair damaged or defective areas of the tubes and form a tight and substantially leak-proof joint.

BACKGROUND OF THE INVENTION

There are a variety of situations in which it is desirable to repair defective or damaged areas of tubes contained within a surrounding structure, such as a tube sheet. By way of example only, large heat exchangers, particularly the type used as steam generators in power plants, typically employ a tube sheet which is a metal plate that can be of varying thickness and has bores of a suitable diameter in which the tubes are inserted. The tubes are often made of stainless steel or carbon steel and act as conduits for fluid. With the passage of time, the interior surfaces of the tubes tend to become eroded, corroded or pitted and may develop cracks, crevices or other defects. These defects especially tend to arise in the area where the tubes and tube sheet define joints. If these defects are left unattended, they decrease the predictable life expectancy of the heat exchanger and associated equipment and may cause undesirable leaking of fluid.

Known techniques for dealing with these defects involve the insertion of a protective sleeve within the tube in the vicinity of the damaged or defective areas of the tube accompanied by radial expansion of the sleeve through a roller expanding process This process employs a mechanical implement which is inserted in the sleeve and pressed against the inner surface of the sleeve so as to force the wall of the sleeve to expand radially outward. The force applied to the wall of the sleeve is also typically sufficient to radially expand the wall of the tube. Upon completion of the process, the tube radially contracts somewhat so as to achieve a press fit with the sleeve.

Roller expanding processes, however, have a number of disadvantages. For one, mechanical rolling of the interior surface of the sleeve tends to result in a sleeve having a wall which is undesirably thin in at least certain areas and, therefore, has less of an anticipated useful life. The reason is that the roller expanding process decreases the thickness of the wall of the sleeve not only due to the change in mathematical area caused by the radial expansion, but also due to deformation of portions of the wall. Moreover, roller expanding processes tend to be time consuming. That is, the rollers can only contact a certain area of the sleeve at any given time. Therefore, the rolling must be performed in stages along the length of the sleeve.

The use of rollers also imposes a minimum dimension on the inside diameter of the sleeve in relation to the wall thickness of the sleeve, since it must be possible to insert rollers of suitable strength and rigidity. Roller expanding processes further tend to leave gaps between the outer surface of the sleeve and the tube. Typically, these gaps are caused by the inherent diametric non-uniformities of the sleeve and tube across their respective lengths or by non-uniformities introduced by defects in the tube. In the case of the latter non-uniformity, the roller expanding process tends to simply "bridge over" the defect, rather than fill in the areas with the expanded wall of the sleeve. Additionally, corrosive agents tend to collect in gaps and may eventually corrode the sleeve or tube.

It should, therefore, be appreciated that there has existed a definite need for a method and apparatus for radially expanding and anchoring a protective sleeve within a tube contained within a surrounding structure that sufficiently repairs a defective or damaged area of the tube and better extends the useful life of the tube and surrounding structure.

SUMMARY OF THE INVENTION

The present invention, which addresses this need, is embodied in a method and apparatus for applying hydraulically pressurized fluid so as to radially pre-expand a sleeve that is contained within a tube and then further expand and anchor the sleeve within the tube by injecting a selectively controlled volume of pressurized fluid into the pre-expanded sleeve The tube is preferably, but not necessarily, contained within a bore in a surrounding structure having a primary side and a secondary side and extends axially beyond the secondary side of the structure. The structure can be a tube sheet.

More particularly, the apparatus may include a hydraulic expanding mandrel, a fluid source for supplying a first pressurized fluid and a second fluid to first and second pumps and a fluid control mechanism for selectively activating the second pump and for controlling the total volume of pressurized fluid discharged by the second pump.

The mandrel may have an elongated body with two axially separated seals and a passage for conveying pressurized fluid The first pump may be driven by the first fluid and preset so as to pressurize the second fluid until the second fluid reaches a predetermined pressure which is above the radial yield point of the sleeve but below the aggregate radial yield point of the sleeve and tube. The second pump is also driven by the first fluid, but is preset so as to pressurize a predetermined volume of the second fluid at a predetermined maximum pressure which is above the aforementioned aggregate yield point. Both pumps can be of the pneumatically driven reciprocating type. The fluid control mechanism is driven by the first fluid and activates the second pump by selectively applying fluid stroke signals to it after the sleeve has substantially pre-expanded into the tube.

In order to radially expand and anchor the sleeve within the tube, the sleeve is first inserted within the tube so that the sleeve extends axially beyond the secondary side of the surrounding structure. The sleeve can also have a flared end portion which protrudes from the tube adjacent to the primary side of the structure. Then, the mandrel is inserted within the sleeve such that the mandrel and sleeve together define a substantially annular hydraulic pressure zone. The pressure zone is situated between the sleeve, the body of the mandrel and the seals.

Thereafter, a first supply of pressurized fluid is introduced into the pressure zone through the passage until a predetermined pressure is reached which is above the radial yield point of the sleeve but below the aforementioned aggregate yield point. The first supply is preferably, but not necessarily, produced by virtue of the first pump pressurizing the second fluid. Consequently, the sleeve pre-expands into the tube substantially radially throughout the pressure zone, while the tube does not radially expand.

Then, a predetermined aggregate volume of a second supply of pressurized fluid is introduced into the pressure zone through the passage for a predetermined volume at a predetermined maximum pressure which is above the aforementioned aggregate yield point. This second supply is preferably, but not necessarily, produced by virtue of the second pump pressurizing the second fluid with the pressurization by the second pump controlled by the fluid control mechanism. Consequently, the sleeve further expands substantially radially throughout the area of the pressure zone that is situated axially beyond the secondary side and the tube expands substantially radially along with the sleeve. When the second supply of pressurized fluid is terminated, the tube contracts and is thereby anchored to the sleeve. The tube and sleeve together, therefore, form a tight and substantially leak-proof joint between the tube and sleeve. Defective areas of the tube and sleeve are thus repaired.

In more detailed aspects of the invention, the first pump is preset so that it pressurizes fluid at a pressure which is substantially midway between the radial yield point of the sleeve and the aforementioned aggregate yield point. Correspondingly, the fluid control mechanism is preset to a predetermined threshold activation pressure so that it activates the second pump upon sensing that the pressure of the first supply exceeds the aforementioned threshold pressure. In that event, the second pump pressurizes the second fluid at a pressure which is above the aforementioned threshold pressure. The fluid control mechanism is further preset so that it continues to actuate the second pump to pressurize the second fluid until the predetermined aggregate volume of the second supply has been injected into the pressure zone. Correspondingly, the second pump is preset so that it pressurizes the second fluid at a pressure which is above the aforementioned aggregate yield point.

In still more detail the aspects of the invention, the fluid control mechanism includes a pilot switch mechanism and an operation switch which together activate a fluid logic mechanism that selectively activates the second pump and controls the stroking of the second pump. The pilot switch mechanism, which is driven by the first fluid, senses the pressure of the second fluid after it has been pressurized by the first pump. (i.e. it senses the pressure of the first supply). It further generates a pilot switch fluid signal when the first pump has pressurized the second fluid to a pressure which is above the aforementioned yield point but below the aforementioned aggregate yield point. The pilot switch mechanism can be preset so that it selectively activates when the pressure of the second fluid is midway between the aforementioned yield point and the aforementioned aggregate yield point.

The operator switch is supplied by the first fluid and activates the first pump by generating an operator fluid signal and presenting the operator signal to the first pump. It also presents the operator signal to the fluid control mechanism so as to pre-pressurize the fluid control mechanism. It then presents this pilot switch fluid signal to the fluid logic mechanism. Upon being presented with the pilot switch and operator signals, the logic mechanism then presents the aforementioned fluid stroke signals to the second pump.

The fluid control mechanism further includes a fluid counter for selectively deactivating the second pump. The fluid counter is driven by the first fluid and detects each fluid stroke signal sent to the second pump by the fluid logic mechanism. Since each fluid stroke signal corresponds to a separate stroke of the second pump, the fluid counter effectively counts the number of strokes of the second pump. It then continuously compares this number with a predetermined total number of expansion strokes preset into the fluid counter and then presents a fluid stroke termination signal to the logic mechanism when the number of strokes equals the total number of expansion strokes. This termination signal serves to interrupt the presentation of stroke fluid signals from the logic mechanism to the second pump.

The apparatus can also include a release valve mechanism which selectively recycles substantially all of the second fluid back to the fluid source. The release valve closes when the operator switch presents an operator fluid signal to it and then opens when the operator signal is terminated so as to prevent further working fluid from being supplied to the pressure zone.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The accompanying drawings illustrate the invention In such drawings.

DESCRIPTION OF THE PREFERRED EMBODIMENT

Figure 1:
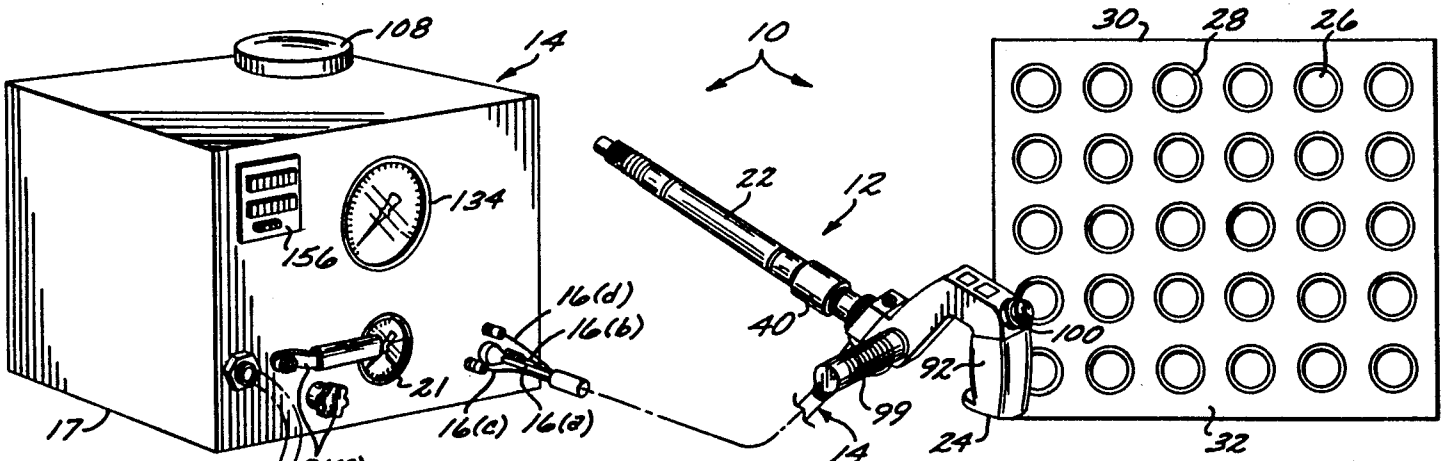
FIG. 1 is a perspective view of a sleeve expansion apparatus constructed in accordance with the present invention and used in practicing the method of the invention.

An apparatus 10, suitable for carrying out the method of the present invention, shown in FIG. 1, includes a hydraulic swaging assembly 12 which is connected to a hydraulic swaging control system 14 through a tubular umbilical 16. The umbilical 16 houses four fluid lines which are made of suitable tubing: a hydraulic fluid line 16(*a*), a fluid supply line 16(*b*), a fluid output line 16(*c*) and a fluid disconnect line 16(*d*). The control system 14 is contained within a housing 17 and is connected through a source tube 18 to a fluid source 20 that supplies a driving fluid which actuates the control system 14. The driving fluid is typically compressed air or any other suitable pressurized operating gas. A gauge 21 is also connected to the fluid source 20, and appears on the face of the housing 17 of the control system 14, for monitoring the pressure of the driving fluid. The fluid source 20 can also be activated and adjusted by a suitable valve mechanism 21(*a*) that protrudes from the housing 17.

Figure 2:
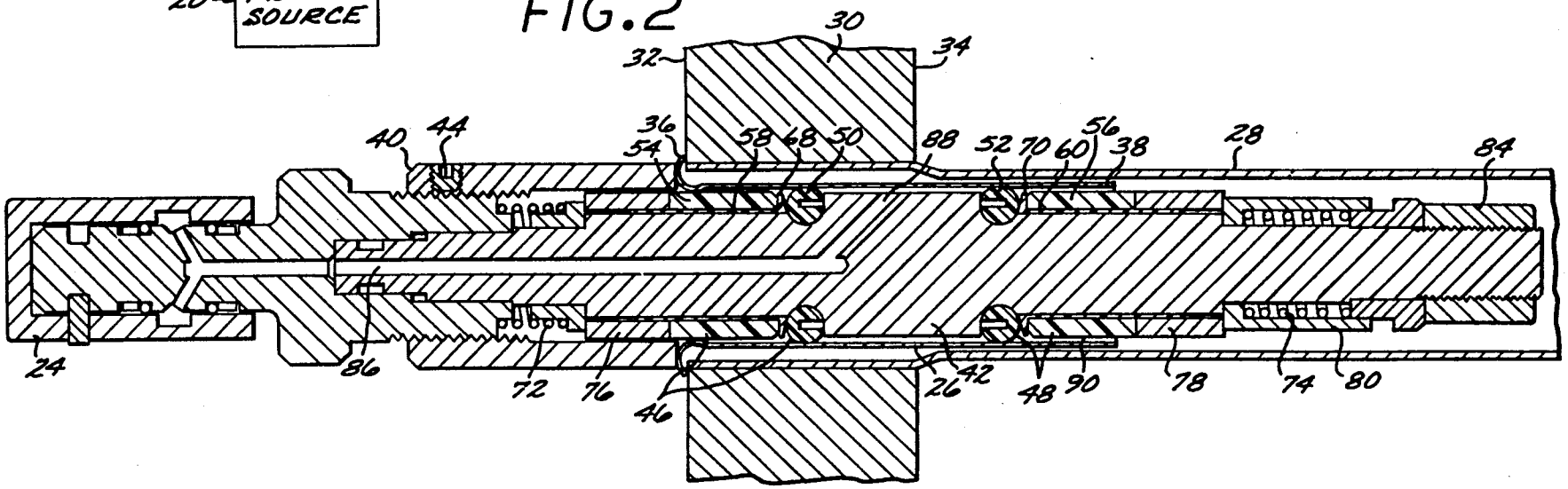
FIG. 2 is a cross-sectional view of a mandrel inserted within an unexpanded sleeve that is contained within a tube that has previously been anchored within a surrounding structure.

As depicted in FIGS. 1–2, the swaging assembly 12 includes a mandrel 22 which is attached to a handle 24 and is to be axially inserted within a protective sleeve 26 that is to be expanded by application of hydraulic swaging pressure. The sleeve 26 itself has previously been inserted within a tube 28 that is confined by surrounding structure 30, which is typically a tube sheet, having a primary side 32 and a secondary side 34. The inner surface of the tube 28 has defects (not visible in the drawings) situated both between the primary and secondary sides 32 and 34 and beyond the secondary side 34.

The end 36 of the sleeve 26 that is adjacent to the primary side 32 is rolled outwardly around the primary side 32 so as to provide a visually verifiable way to subsequently determine that the sleeve 26 is properly positioned to the tube 28 (See FIG. 2). It will be appreciated that this rolling feature is standard practice in connection with a number of hydraulic swaging applications. The other end 38 of the sleeve 26 extends beyond the secondary side 34 of the structure 30 so as to allow for the repair of defective or damaged areas of the tube 28 that extend beyond the structure 30.

The mandrel 22 includes a cylindrical collar 40 which is threadedly attached to the bottom of an elongated body 42 that is generally cylindrical. The collar 40 rests against the rolled end 36 of the sleeve 26 and thereby serves as a stop to properly position the swaging assembly 12 within the sleeve 26 and tube 28. It can also be adjusted so as to better position the mandrel 22 by releasing a locking set screw 44 that secures the collar 40 to the body 42 and then threading the collar 40 along the body 42. It will be observed that the precise configuration of the collar 40 will depend upon the particular configuration and dimensions of the rolled end 36 of the sleeve 26.

For the purpose of properly expanding the sleeve 26, the mandrel 22 further has first and second seal subassemblies 46 and 48 which encircle the body 42 adjacent to the mid-section of the sleeve 26. Each seal subassembly 46 and 48 is structurally similar and includes a primary seal, 50 and 52 respectively, and accompanying expander rings 54, and 56 respectively, which surround and ride on equalizer rings, 58 and 60 respectively, that encircle the body 42. Each primary seal 50 and 52 is typically a soft and resilient O-ring and is normally seated in a circumferential groove, 62 or 64 respectively, defined by the body 42. Each seal 50 and 52 is also capable of withstanding very high pressures (e.g. 12,000 psi), provided it is not exposed to any gap or unsupported areas into which it can be extruded beyond its elastic limit while hydraulic swaging pressure is being applied.

The seals 50 and 52 are also in contact with the sleeve 26 and define the opposite ends of a substantially annular hydraulic pressure zone. The pressure zone extends in an axial direction between the inner surface of the sleeve 26 and the outer surface of the body 42. Each seal 50 and 52 thus makes direct contact with hydraulically pressurized fluid so as to prevent the pressurized fluid from escaping from the pressure zone.

Each expander ring 54 and 56 is cylindrical and typically made of any suitable material, such as elastically deformable polyurethane, that has the desired memory characteristics. That is to say, it behaves like a fluid at very high pressures so as to radially expand the tube 28 (e.g. 12,000 psi), but returns substantially to its equilibrium configuration if its elastic limits are not exceeded. Each expander ring 54 and 56 further fits tightly on its corresponding equalizer ring 58 or 60 and does not move angularly or radially with respect to its corresponding equalizer ring 58 or 60.

Each equalizer ring 58 and 60 defines a flanged end portion 68 and 70 which projects radially outwardly at one end of the ring 58 and 60 and is disposed between its corresponding primary seal 50 and 52 and companion expander rings 54 and 56. The clearance between each equalizer ring 54 and 56 and the body 42 is also very small in comparison to the length of each equalizer ring 54 and 56 so that the equalizer rings 54 and 56 cannot be cocked or moved angularly to any significant extent.

In order to better permit the first and second seal sub-assemblies 46 and 48 to properly confine pressurized fluid within the pressure zone and return substantially to equilibrium, the mandrel 22 further includes coil springs 72 and 74 and support rings 76 and 78 which each encircle the body 42 (see FIG. 2). Each support ring 72 and 74 is disposed between its corresponding coil spring 72 and 74 and expander ring 54 and 56 and abuts its companion expander ring 54 and 56 respectively. The inner surface of each support rings 76 and 78 is also undercut so as to provide an annular space between the surface and the body 42 into which the equalizer rings 58 and 60 respectively can move axially away from their corresponding primary seals 50 and 52. The support rings 76 and 78 each limit the axial movement of their corresponding equalizer rings 58 and 60 along the body 42 away from the hydraulic pressure zone.

The coil spring 72 associated with the first seal subassembly 46 is encircled by the collar 40, while the coil spring 74 associated with the first seal sub-assembly 48 is preferably encircled by a spring guide 80 which guides the axially movement of the spring 74. The axial movement of the spring 74 is restrained by a nut 84 threadedly attached near the top of the mandrel 22. Each coil spring 72 and 74 tends to urge its corresponding primary seal 50 and 52 back toward its corresponding circumferential groove 62 and 64 in which it normally resides in equilibrium once the primary seal 46 and 48 has moved axially along the body 42 away from the hydraulic pressure zone.

For the purpose of conveying pressurized fluid to the pressure zone, the body 42 of the mandrel 22 further defines an interior fluid passage 86 and a fluid port 88 which is situated on the surface of the body 42 and lies within the pressure zone. As shown in FIG. 2, the passage 86 extends axially through the mid-section of the body 42 from the handle 24 and then slopes upward toward the exterior surface of the body 42 until it terminates at the fluid port 88.

By reference to FIG. 2, it will be observed that insertion of the mandrel 22 into the sleeve 26 results in a small annular space 90 being defined between the sleeve 26 and the mandrel 22, except where the primary seals 50 and 52 contact the inner surface of the sleeve 26. The annular space 90, which is somewhat exaggerated in size for purposes of illustration, has a variable radial cross-section due to variations in the diameter of the mandrel 22. The portions of the annular space 90 that are situated above the expander rings 54 and 56 and above the support rings 78 and 80 are known as "extrusion gaps." Upon application of hydraulically pressurized fluid, these gaps will increase in size as the sleeve 26 and tube 28 expand under pressure.

It will be understood that it is preferable to carefully assess the original size and increases in size of the extrusion gaps in advance in order to insure proper expansion of the sleeve 26 and tube 28 and the selection of appropriate expander rings 54 and 56. If the extrusion gaps are not confined within the load supporting capacity of the expander rings 54 and 56, the expander rings 54 and 56 will tend to extrude plastically, rather than elastically, into their corresponding extrusion gaps. Consequently, the first and second seal sub-assemblies 46 and 48 may become ineffective and the mandrel 22 damaged.

It will be further understood that the particular type of mandrel 22 chosen will depend upon the particular material properties of the sleeve 26 and tube 28 and the differences in diameter of the tube 28 due to its previously being expanded into the surrounding structure 30. Moreover, the mandrel 22 should preferably have a size and configuration which allows it to slide easily within the sleeve 26, while at the same time maintaining an initial "squeeze" between the sleeve 26 and mandrel 22 that will permit the primary seals 50 and 52 to maintain proper contact with the sleeve 26 throughout the expansion process. (See FIGS. 2–4). A related mandrel is described in U.S. Pat. No. 4,359,889 previously assigned to Haskel, Inc.

Figure 5:
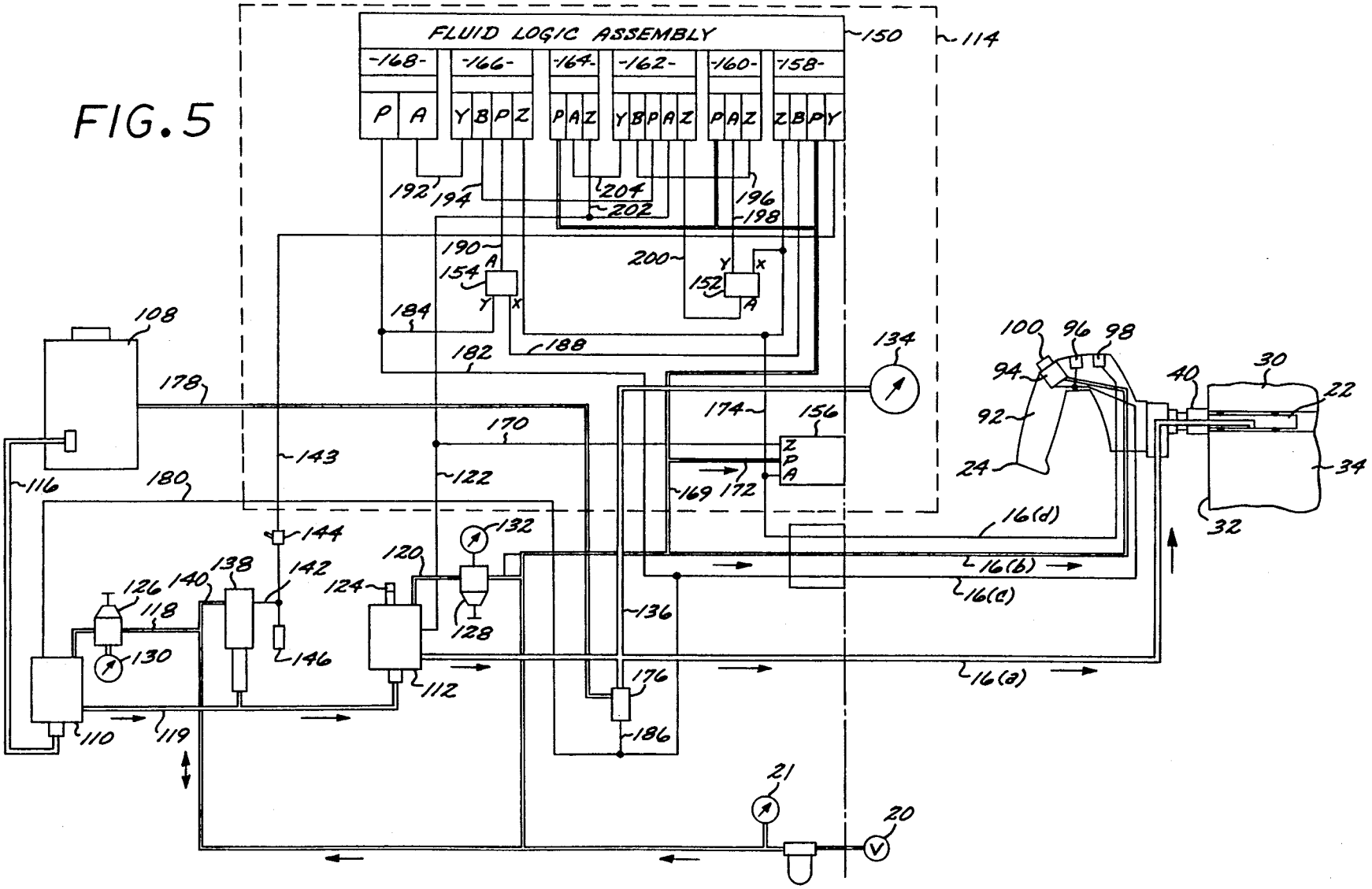
FIG. 5 is a largely schematic representation of the swaging control system of the sleeve expansion apparatus of FIG. 1 connected to the swaging assembly, and further shows a partially cut-away view of the swaging assembly.

As shown in FIGS. 1 and 5, the handle 24 includes a primary holder 92 which has a substantially U-shaped cross section and houses an operator control switch 94 and a pair of swaging indicators 96 and 98. The handle 24 is preferably configured so that it can be easily grasped and manipulated by a human hand and can properly hold the mandrel 22 during the expansion process. To that end, it can also have a cylindrical secondary holder 99 which is attached to the primary holder 92 adjacent to the collar 40 and oriented substantially perpendicular to the U-shaped cross section of the primary holder 92. (See FIG. 1).

The operator switch 94 is capped by a depressible control button 100, which protrudes from the top surface of the primary holder 92, and is connected to the fluid output line 16(*c*) and to the fluid input line 16(*b*) which is itself connected to the fluid source 20 that supplies driving fluid to the switch 94. As more fully discussed below, when the button 100 is depressed, the switch 94 actuates the control system 14, thereby initiating the expansion process. The switch 94 is capable of receiving driving fluid through input line 16(*b*) and diverting it through output line 16(*c*). In the case where the driving fluid is a compressed gas, the switch 94 is any appropriate pneumatic valve having the aforementioned characteristics.

The indicator 96 is connected to the output fluid line 16(*c*) and signals that the apparatus is operating by detecting flow of fluid through the output line 16(*c*). On the other hand, the indicator 98 is connected to the fluid disconnect line 16(*d*) and signals the completion of the expansion process upon detecting a stroke termination, fluid signal from the control system 14. Each indicator 96 and 98 is a suitable indicator, typically of the pneumatic type.

The swaging control system 14 regulates the flow of hydraulically pressurized fluid through hydraulic fluid line 16(*a*) into the pressure zone so that the sleeve 26 is properly expanded and anchored within the tube 28. As shown schematically in FIG. 5, it includes a hydraulic fluid source or tank 108, which supplies working fluid to first and second pumps 110 and 112, and a hydraulic fluid circuit 114 which controls the expansion of the sleeve 26 and tube 28 under hydraulic pressure The tank 108 is preferably, but not necessarily, made of high density polyethylene and is capable of holding two gallons of a working fluid which is typically distilled or purified water. It is also connected to the first pump 110 through a tube or hose 116 which supplies the working fluid to be pressurized.

A fundamental purpose of the first pump 110 is to provide hydraulically pressurized fluid to the pressure zone which is sufficient to expand the sleeve 26 into the tube 28 but insufficient for combined expansion of the sleeve 26 and the tube 28. It is of the reciprocating type and is driven by driving fluid supplied by the fluid source 20 through fluid line 118. Pumps similar to the first and second pumps 110 and 112 are described in U.S. Pat. Nos. 3,963,383 and 4,405,292.

As depicted in FIG. 5, the first pump 110 is also activated by fluid in the form of a pilot or operator fluid signal which is presented to a pilot valve contained within an actuator chamber (not shown) within the pump 110 through the fluid output line 16(*c*) when the button 100 is depressed. Once activated, the first pump 110 compresses working fluid conveyed to it through the hose 116 and discharges the now hydraulically pressurized fluid through the hydraulic fluid pump line 119. The volume of fluid discharged by the first pump 110 per stroking cycle of the pump 110 is essentially predetermined by the displacement characteristics of the pump 110 and is relatively constant.

The particular type of first pump 110 chosen will largely depend upon the material properties of the sleeve 26 and the properties of the driving fluid. Nevertheless, it should pressurize the working fluid from tank 108 at a pressure which is effectively somewhat above the radial yield point of the sleeve 26, but below the aggregate radial yield point of the sleeve 26 and tube 28. This will tend to insure that the sleeve 26 properly expands into both the pre-expanded and initially unexpanded portions of the tube 28 (see FIG. 2) and will "zero out" any tolerances within the sleeve 26. Since the driving fluid supplied by the fluid source 20 is preferably compressed air, the first pump 110 is also preferably an air driven reciprocating pump, such as model no. MS72 sold by Haskel, Inc., which has an output pressure of about 8,800 psi. In that regard, an air driven pump which operates at an air pressure of 70 to 80 psi is ordinarily sufficient to properly pre-expand the sleeve 26 into the tube 28.

A fundamental purpose of the second pump 112 is to expand the tube 28 and to further expand the sleeve 26 beyond its pre-expanded state so that the sleeve 26 is properly anchored to the tube 28 and forms a substantially leakproof joint with it. Like the first pump 110, the second pump 112 is driven by driving fluid from the fluid source 20. This time, however, the driving fluid is supplied through fluid line 120, rather than fluid line 118. Moreover, as more fully set forth below, the second pump 112 is selectively activated and stroked by the fluid control circuit 114.

The circuit 114 presents a predetermined number of pilot or stroke fluid signals through fluid line 122 to a pilot valve contained within the actuator chamber (not shown) within the second pump 112. Once activated, the second pump 112 compresses working fluid conveyed to it from the hydraulic fluid pump line 119 and discharges it through hydraulic fluid line 16(*a*) into the pressure zone. (See FIG. 5). It should be noted that one end of the pump line 119 is connected to the first pump 110, while the other end is connected to the second pump 112. As a result, working fluid from the tank 108 is initially pressurized by the first pump 110 before flowing through the pump line 119.

The particular type of second pump 112 selected will depend upon the material properties of the sleeve 26 and tube 28 and the properties of the fluid that drives the pump 112. Nevertheless, the pump 112 should be able to pump an aggregate volume of hydraulic fluid that is sufficient enough for combined expansion of the sleeve 26 and tube 28 and anchoring of the sleeve 26 to the tube 28. To that end, the pump 112 should pump the working fluid to a predetermined maximum pressure which exceeds the aforementioned aggregate yield point of the sleeve and tube.

Since the fluid supplied by the fluid source 20 is preferably compressed air, the second pump 112 is preferably an air driven reciprocating pump such as model no. MS110 sold by Haskel, Inc., which has an output pressure of about 11,000 psi. The MS110 pump is driven by air at a pressure of 100 psi with a displacement per stroke of 0.039 cubic inches or 0.6 mls. As is well-known, the second pump 112 can also have a stroke adjustment mechanism 124 which adjusts the stroke of the pump 112 and, thereby controls the volume of fluid pumped per pump stroke. It can be used to fine tune the precise volume of fluid pumped per stroke of the pump 112.

Both the first and second pumps 110 and 112 can also be associated with regulators 126 and 128 which can be used to adjust the pressure of the driving fluid input into the pumps 100 and 112 from the fluid source 20. As shown in FIG. 5, the regulators 126 and 128 are connected to the fluid lines 118 and 120 respectively and have gauges 130 and 132 respectively. The regulator 126 is employed to preset the fluid drive pressure of the driving fluid so that the first pump 110 will pump the working fluid from the tank 108 to a pressure that is above the yield point of the sleeve 26, but below the aforementioned aggregate yield point Correspondingly, the second regulator 128 is used to preset the fluid drive pressure so that the second pump 112 compresses the working fluid to a pressure that is a above the aforementioned aggregate yield point. Since the driving fluid that drives the pumps 110 and 112 is typically compressed air from the fluid source 20, the regulators 126 and 128 are preferably of the pneumatic type. The gauges 130 and 132 are preferably suitable for measuring pressure within the zero to 160 psi. range. The gauge 21 shown in FIG. 1 and 5 is on the face of the housing 17 of the swaging control system 14 and shows pressure of source 20.

For the purpose of monitoring the pressure of the working fluid that has been pressurized by either first and second pumps 110 and 112, the control system 14, also includes a suitable high pressure gauge 134. The gauge 134 is connected to the hydraulic fluid line 16(*a*) through hydraulic line 136 and is preferably capable of measuring pressures between zero and 20,000 psi. When the first pump 110 is pressurizing fluid, gauge 134 reflects the tensile strength of the sleeve 26 or its effective resistance to being expanded by the hydraulically pressurized fluid. Correspondingly, when the second pump 112 is pressurizing fluid, the gauge 134 reflects the tensile strength of the combined sleeve 26 and tube 28 or their effective resistance to being expanded by the controlled volume of hydraulically pressurized fluid being ejected into the pressure zone. The gauge 134 is advantageously situated on the face of the sleeve control system 14 so that the pressure can be easily monitored by the operator. (See FIG. 1).

The control system 14 also has a fluid pilot switch 138 which tends to insure that the fluid control circuit 114 automatically activates the second pump 112 once the first pump 110 has pre-expanded the sleeve 26. As shown schematically in FIG. 5, the switch 138 is connected to the fluid source 20 through switch fluid input line 140 and to the hydraulic fluid pump line 119 from which it continuously senses the pressure of the working fluid that the first pump 110 has hydraulically pressurized The switch 138 is also preset such that it will open when this pressure is a predetermined amount above the radial yield point of the sleeve 26, but below both the aggregate radial yield point of the sleeve 26 and tube 28 and the output pressure of the first pump 110. In typical applications, this predetermined amount is midway between the aforementioned yield points.

When the switch 138 opens, it conveys driving fluid in the form of a pilot switch fluid signal from fluid source 20 to the control circuit 114 through fluid output lines 142 and 143. Since the fluid is typically compressed air, the switch 138 is of the pneumatic type, and conveys the driving fluid at a relatively constant pressure The pilot switch 138 can also have a suitable toggle switch 144 which is connected to fluid line 143 and a pilot switch indicator 146 which is connected to output line 142. (See FIG. 5). As discussed later, the toggle switch 144 and indicator 146 are used as part of the set-up procedure for the control system 14.

The fluid control circuit 114 (see dotted lines in FIG. 5) selectively cycles the second pump 112 on and off for a predetermined number of pump strokes so as to control the aggregate volume of hydraulically pressurized fluid supplied by the second pump 112 to the pressure zone. It, therefore, insures that the second pump 112 supplies a volume of pressurized fluid that is sufficient to properly expand the sleeve 26 and tube 28 and create a tight and substantially leakproof joint between them.

More particularly, the control circuit 114 includes a fluid logic assembly 150 which interacts with "OR" and "AND" gates 152 and 154 and a fluid counter 156 that together control the flow of fluid (generally, in the form of fluid signals) within the assembly 150. The logic assembly 150 has six fluid actuated fluid valves 158, 160, 162, 164, 166 and 168 which are supplied with fluid from fluid source 20.

The valve 168 is a suitable "one-shot" valve. It has a fluid inlet port P which is supplied with driving fluid in the form of an operator fluid signal through fluid line 16(*c*) and a fluid output port A for sending a fluid pulse derived from fluid supplied to port A by port P. When port P is pressurized by driving fluid, the fluid pulse is sent from port A for a predetermined duration of time. The valve 168 then resets itself once driving fluid is no longer incident at port P.

The valves 158 and 166 are generally identical to each other and are double pilot valves with detented manual override. Each valve 158 and 166 has a pair of fluid pilot ports Y and Z, which selectively receive separate pilot fluid signals, a fluid supply port P and a fluid outlet port B. The pilot fluid signals are not present at the ports Y and Z, respectively, at the same time. Instead they arrive at different times and, therefore, shift the valve 158 or 166 back and forth so as to alternatively block and open port B.

The valves 160 and 164 are generally identical to each other and are any suitable fluid actuated valves with time delays. Each valve has a fluid pilot port Z, which selectively receives pilot fluid signals and which, after a preset time delay, shifts and transfers driving fluid earlier presented to port P of the valve 160 or 164 to its corresponding fluid outlet port A.

Finally, the valve 162 is any suitable fluid actuated valve which, in conjunction with valves 160 and 164, can selectively transmit fluid stroke signals through fluid line 122 so as to stroke the second pump 112. One such valve is a fluid actuated double pilot valve with detented manual override. The valve 162 includes a pair of pilot ports Y and Z, which selectively receive separate pilot fluid signals, a pair of fluid outlet ports A and B and a fluid supply port P. Like the valves 158 and 166, pilot fluid signals are not present at ports Y and Z of the valve 162 at the same time. Instead, they arrive at different times and, therefore, shift the valve 162 back and forth so as to alternatively open and block port A.

Since the fluid source 20 is preferably compressed air, the valves 158–168, gates 150 and 152, and fluid counter 156 are all pneumatically actuated. The interaction of these components will become more apparent from ensuing discussion of the operation of the apparatus.

The fluid counter 156 has a fluid supply port P, a pilot signal countdown port Z and a control system disconnect port A. The supply port P is connected to the fluid source 20 through a fluid line 170. The port P, therefore, receives driving fluid at a relatively constant pressure so as to drive the fluid counter 156. The countdown port Z is connected by a fluid line 172 to the fluid line 122 so that the fluid counter 156 can detect the number of pilot or stroke fluid signals sent to the second pump 112. The control system disconnect port A is connected to port Z of valve 158, port Z of valve 166 and to the swaging indicator 98. As more fully discussed below, it selectively sends a fluid stroke termination signal to these ports and to the indicator 98 along fluid line 174 so as to deactivate the second pump 112 and inform the operator that the expansion process of the sleeve 26 and tube 28 has been is completed.

For the purpose of recycling substantially all of the working fluid into the tank 108, the swaging control system 14 also has a suitable fluid release valve 176. The valve 176 is supplied with driving fluid from the fluid source 20 through fluid output line 16(*c*) and is connected to the tank 108 though a fluid recycle line 178. The release valve 176 remains closed until the operator interrupts the supply of driving fluid by ceasing to depress the button 100 of the operator control switch 94. When the operator does so, the release valve 176 opens and permits substantially all of the working fluid to return to the tank 108 through the recycle line 178.

The operation of the apparatus 10 and the accompanying method of radially expanding and anchoring the sleeve 26 within the tube 28 will now be discussed. Preliminary, it is typically appropriate to preset various components of the swaging control system 14 so that the apparatus 10 will perform properly. This set-up procedure is preferably undertaken by empirically assessing the yield point of the sleeve 26 and the aggregate yield point of the sleeve 26 and tube 28. More particularly, the operator grasps the handle 24 of the swaging assembly 12 and inserts the mandrel 22 or any other suitable mandrel within a sleeve of the type that is to be expanded and anchored within the tube 28. (See FIG. 5). The operator then depresses the button 100, thereby causing the operator control switch 94 to open and admit the driving fluid to fluid output line 16(*c*) from fluid input line 16(*b*).

Then, operator or pilot fluid signals (typically in the form of a constant supply of compressed air) are supplied through the fluid output line 16(*c*) to the first pump 110 and port P of the valve 168. As evident from FIG. 5, a fluid line 180 connects fluid line 16(*c*) to the actuation chamber (not shown) of the first pump 110, while a fluid line 182 connects the line 16(*c*) to port P. Moreover, driving fluid enters respective P ports of the valves 158, 160 and 164 through fluid line 169 from fluid input line 16(*a*) so as to pre-pressurize the valves 158, 160 and 164.

When the first pump 110 receives an operator or pilot fluid signal, it activates and begins pumping working fluid received from the tank 108 through the hose 116. In that regard, the pressure of the fluid pressurized by the first pump 110, can be increased or decreased by using the regulator 126 to adjust the pressure of the fluid driving fluid. The resulting hydraulically pressurized fluid is then transferred to the pressure zone successively through hydraulic fluid lines 119 and 16(*a*). At the same time, the toggle switch 144 is maintained in an off or closed setting so that the fluid control circuit 114 does not activate the second pump 112.

The sleeve 26 then expands radially. The expansion of the sleeve 26 is measured by suitable measurement instrumentation, such as a continuous indicating caliper which has been clamped over the sleeve prior to its expansion. When the measurement instrumentation indicates that the sleeve has radially expanded to its yield point, the pressure of the hydraulically pressurized fluid is observed on the pressure gauge 134 and recorded by the operator. This observed pressure is then the pressure at which the sleeve yields. Moreover, as a result of appropriate adjustment of the regulator 126 during the expansion process, the first pump 110 has effectively been preset to compress the driving fluid to the desired pressure.

The aforementioned aggregate yield point is then determined. The operator places an appropriate sleeve within a tube that is similar to the type of tube contained within the structure 30 and inserts a suitable mandrel within the sleeve. The operator then opens the toggle switch 144 so as to permit the supply of pilot switch fluid signals through fluid lines 142 and 143 that are needed for the logic assembly 150 to activate the second pump 112. Next, the button 100 is depressed, thereby activating the first and second pumps 110 and 112 as discussed more fully below. The operator then observes the combined yielding of sleeve and tube via suitable measuring instrumentation and counts the number of strokes of the second pump 112 via the fluid counter 156. The operator records the pressure reading on the high pressure hydraulic gauge 134. This reading corresponds to the pressure at which the sleeve and tube yield in combination.

Once the aforementioned yield and aggregate yield points have been accessed, the first and second pumps 110 and 112 and the pilot switch 138 are preset or adjusted as appropriate. More particularly, the regulator 126 is set up so that driving fluid is supplied to the first pump 110 at a pressure which results in the first pump 110 pumping hydraulically pressurized fluid to a pressure which is above the yield point of the sleeve 26 but below the aforementioned aggregate yield point. Correspondingly, the regulator 128 is set up so that driving fluid is supplied to the second pump 112 at a pressure which results in the pump 112 pumping hydraulic fluid to a maximum pressure which exceeds the aggregate yield point of the sleeve 26 and tube 28.

Next, since the aforementioned yield and aggregate yield points have now been determined, the fluid pilot switch 138 is preset in accordance with a well-known manner for switches of this type. The switch 138 is preset so that it will not be activated until the working fluid pressurized by the first pump 110 reaches a pressure which is above the aforementioned yield point but below the aforementioned aggregate yield point. As a useful rule of thumb, the pressure setting should be midway between the aforementioned two points. This particular setting will tend to better compensate for differing pressure requirements caused by variations in tube dimensions and for air switch dead band and hysteresis. It will be understood that to ensure proper activation of the pilot switch 138 the first pump 110 is preset such that it pumps working fluid to a pressure which is above the preset threshold activation pressure for the switch 138.

In order to verify that the switch 138 has been properly preset, the first pump 110 is preferably activated and the toggle switch 144 is closed. The operator then activates the first pump 110 as described above and observes the pilot switch indicator 146. If necessary, the operator then adjusts the regulator 126 so as to gradually increase the pressure of the driving fluid supplied to the first pump 110. Consequently, the first pump 110 discharges working fluid at an increasing pressure. When the fluid has exceeded the desired pressure, the pilot switch indicator 146 indicates that the switch 138 has opened.

The final aspect of the preliminary set up procedure involves presetting the pneumatic counter 156 so as to preset the number of times the second pump 112 will be stroked. It will be understood that the number of pump strokes required is a function of the changes in the respective volumes of the sleeve 26 and tube 28 due to their radial expansion and of the volume of working fluid displaced by the pump per stroke.

After any appropriate presetting of the control system 14 has been accomplished, the apparatus 10 can be used to efficiently expand and anchor sleeves and tubes having material properties similar to those employed in the set up procedure. The expansion process commences with the operator activating the fluid source 20. Consequently, pressurized driving fluid, which is typically pneumatic in nature, flows to the first and second pumps 110 and 112 through fluid lines 118 and 120, respectively, and the operator control switch 94 through fluid input line 16(*b*) and to the respective P ports of valves 158, 160 and 164. The operator then grasps the handle 24 of the swaging assembly 12 and inserts the mandrel 22 within the sleeve 26 that is to be expanded and anchored within the tube 28.

Thereafter, the operator depresses the button 100 of the control switch 94, thereby causing operator fluid signals to be applied to the first pump 110 and to port P of the valve 168 as described in conjunction with the previous set-up procedure discussion. Again, the operator fluid signals are typically in the form of a constant supply of pressurized air. Consequently, the first pump 110 is activated by the driving fluid supplied to it through fluid line 118.

At the same time, a portion of the operator signal flowing through the fluid line 182 to port P of valve 168 is diverted through fluid line 184 and presented to the AND gate 154. The "AND" gate 154 does not, however, at this stage exhaust any fluid signal through its port A, since only one condition (i.e., a fluid signal incident at port Y) is met. Concurrently, the fluid signal flowing through output line 16(*c*) activates the swaging indicator 96 so as to verify to the operator that the apparatus 10 is operating. A portion of the fluid signal flowing through output fluid line 16(*c*) is also diverted through fluid line 186 so as to close the release valve 176. As a result, the valve 176 now prevents working fluid from being recycled to the tank 108 during the expansion process.

The first pump 110 then pumps working fluid supplied to it from the tank 108 through hose 116 and discharges the fluid at a previously predetermined pressure. As shown in FIG. 5, the hydraulically pressurized fluid flows successively through the fluid line 119 and the presently inactive second pump 112 and through the hydraulic fluid line 16(*a*). It then passes through the passage 86 within the mandrel 22 and into the pressure zone.

The fluid pilot switch 138, which is connected to the fluid line 119, continuously senses the pressure of the working fluid that has been pressurized by the first pump 110. It also remains closed as long as the pressure of the working fluid does not exceed the preset threshold activation pressure of the switch 138. Consequently, until this threshold pressure is exceeded, the switch 138 prevents driving fluid from entering the switch 138 from the fluid source 20 along fluid line 140. It will be understood that the toggle switch 144 has been opened before the beginning of the expansion process, since the switch 138 has previously been preset.

As long as the switch 138 remains closed, a fluid signal (typically, in the form of a constant supply of compressed air) is not presented to port Y of valve 158 successively through fluid lines 142 and 143. Therefore, the valve 158 will not shift so as to allow fluid signals to exit port B of the valve 158. Moreover, a fluid signal cannot at this stage be presented to port X of the AND gate 154 through fluid line 188 and the AND gate 154 remains closed. The fluid logic assembly, therefore, remains inactive and will not transmit pilot or stroke fluid signals through fluid line 122 that are needed to activate the second pump 112.

Figure 3:
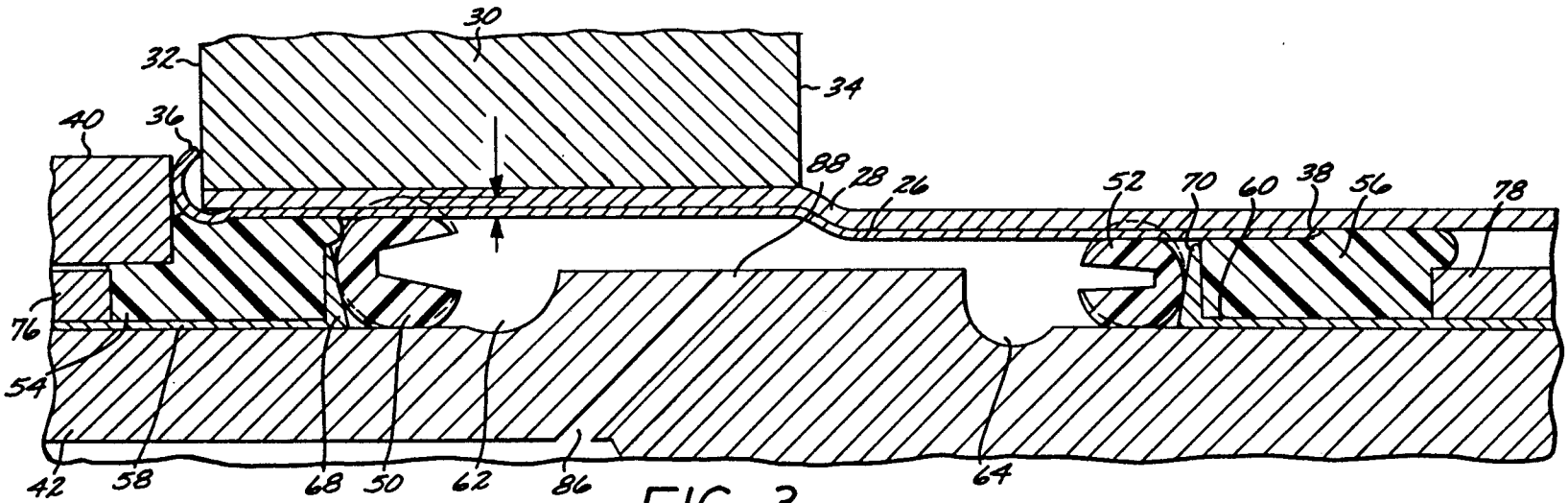
FIG. 3 is an enlarged, fragmentary cross-sectional view which is somewhat similar to FIG. 1, but shows the sleeve, tube, surrounding structure and mandrel after hydraulic pressure has been applied to radially pre-expand the sleeve.
Figure 4:
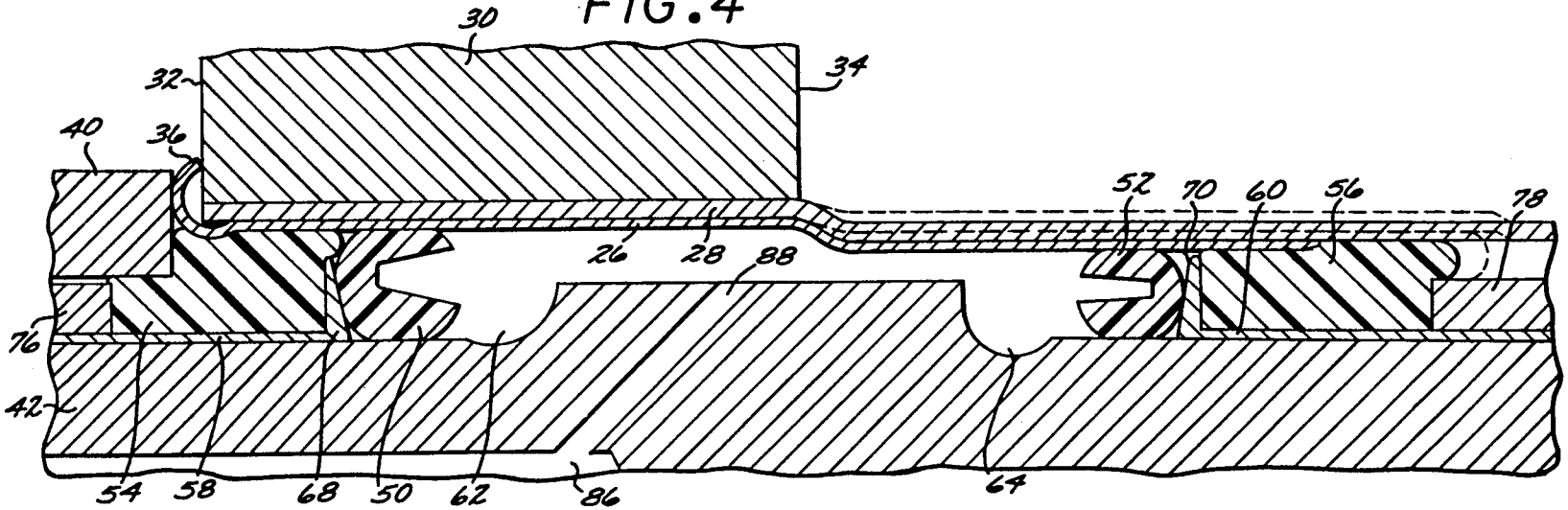
FIG. 4 is an enlarged, fragmentary cross-sectional view which is somewhat similar to FIG. 3, but with dotted lines showing further radial expansion of the sleeve and radial expansion of the tube and expander rings of the mandrel under increased hydraulic pressure.

As manifested by comparing FIGS. 2 and 3, hydraulically pressurized fluid within the pressure zone causes the primary seals 50 and 52 to exert an axial force against their corresponding equalizer rings 58 and 60. Consequently, the seals 50 and 52 are unseated from their respective circumferential grooves 62 and 64 and move axially along the body 42 of the mandrel 22. The movement of the primary seals 50 and 52 in turn causes their corresponding expander and support rings 54, 76 and 56, 78, respectively, to move axially away from the pressure zone and compresses their corresponding coil springs 72 and 74. The primary seals 50 and 52 and their corresponding expander rings 54 and 56 also tend to expand radially, as they are compressed axially between the pressure zone and the coil springs 72 and 74. Moreover, each expander ring 54 and 56 tends to expand into the particular sleeve extrusion gap defined earlier (see FIG. 3).

The hydraulically pressurized fluid, in conjunction with the expansive radial force exerted by the primary seals 50 and 52 and expander rings 54 and 56 on the sleeve 26, causes the sleeve 26 to radially expand into contact with the tube 28. (Compare FIG. 2 with FIG. 3) Nevertheless, the tube 28 does not expand, since the pressure of the hydraulic fluid does not exceed the aggregate yield point of the sleeve 26 and tube 28.

As the first pump 110 continues to discharge pressurized hydraulic fluid, the pressure of the hydraulic fluid eventually exceeds the preset threshold activation pressure of the pilot switch 138. Concurrently, the pilot switch indicator 146 activates so as to confirm that the switch 138 is open. Thus, the switch 138 opens and permits a pilot switch fluid signal (typically, a constant supply of pressurized air) to flow successively through switch fluid output lines 142 and 143. Thereafter, this pilot fluid signal is presented to port Y of the valve 158.

Once a pilot fluid signal is presented to port Y, the valve 158 shifts and generates a fluid signal which exits port B of the valve 158. This fluid signal is then presented to port X of the AND gate 154 (typically a normally closed, pneumatically-piloted spring return three-way valve) through the fluid line 188. The AND gate 154 then opens because both conditions for its activation are present (i.e. fluid signals at both ports X and Y of the gate 154). Operating with a snap action, the AND gate 154 outputs a fluid signal from its port A and presents it to port P of the valve 166 through a fluid line 190.

It will be recalled that, when the operator earlier initiated the expansion process by depressing the button 100, an operator fluid signal was presented to port P of the valve 168 through fluid line 182. The valve 168 produces a pilot pulse to port A of valve 168. This pilot pulse (typically in the form of a fluid signal) is then presented to pilot port Y of valve 166 through a fluid line 192. Since fluid signals now have been presented at both ports Y and P of the valve 166, the valve 166 shifts and exhausts a fluid signal from port B of the valve 166. This fluid signal is then presented to port P of the valve 162 through a fluid line 194. This fluid signal then exits port B of the valve 162 and is presented to pilot port Z of the valve 160 through a fluid line 196.

After the amount of time delay preset into the valve 160 has elapsed, the valve 160 shifts and exhausts a fluid signal from its port A. This fluid signal is then presented to port Y of the OR gate 152 through fluid line 198. The OR gate 152 then opens because two conditions are met (i.e. a fluid signal at port Y of the gate 152 and no fluid signal at port X of the gate 152). The fluid signal then exits port A of the AND gate 154 and is presented to pilot port Z of the valve 162 through a fluid line 200.

The OR gate 152 is typically a conditionally open, air piloted, spring return three-way valve which has two fluid input ports X and Y and a fluid output port A. It automatically blocks the non-pressurized input port. However, if both input ports are pressurized, it outputs the higher pressure of the two ports.

Upon receiving a fluid signal at its port Z, the valve 162 shifts such that a pilot or fluid stroke signal exits port A of the valve 162 and is presented to the pilot valve within the actuator chamber (not shown) of the second pump 112 through the fluid line 122. Therefore, driving fluid enters the pump 112 through fluid line 120 and the second pump 112 commences stroking The second pump 112 then pumps working fluid, which has already been pressurized by the first pump 110, supplied to it through the hydraulic fluid line 119 and discharges hydraulically pressurized fluid through the hydraulic fluid line 16(*a*).

Thereafter, this pressurized fluid passes through the passage 66 within the mandrel 22 and into the pressure zone. As a result, the sleeve 26 continues to expand radially and the tube 28 expands radially along with it (Compare FIG. 3 with dotted lines in FIG. 4). The first and second seal sub-assemblies 46 and 48 function essentially as previously described, albeit it under increased fluid pressure. It will be appreciated that the first pump 110 also continues to pressurize the working fluid, since it is still being actuated by operator fluid signals supplied through the fluid output line 16(*c*).

As the fluid stroke signal from port A of the valve 162 flows through fluid line 122, it is also partially diverted to pilot port Z of the valve 164 through a fluid line 202. Then, after a predetermined amount of time which has been preset into the valve 164 elapses, the valve 164 shifts such that a fluid signal exits port A of the valve 164. This fluid signal is thereafter presented to pilot port Y of the valve 162 through a fluid line 204. Upon receiving this fluid signal, the valve 162 shifts so as to close port A and open port B of the valve 162. Since port A of the valve 162 is now closed, further fluid stroke signals temporarily cannot be presented to the second pump 112 through the fluid line 122. Concurrently, the fluid signal exits port B of the valve 162 and is presented to pilot port Z of the valve 160 through a fluid line 206. The valves 160, 162 and 164 then repeat the same cycle described above.

It will be appreciated that the valves 160 and 164 control the stroking of the second pump 112, and therefore the aggregate volume of pressurized fluid injected into the pressure zone, by selectively initiating and interrupting the supply of pilot or stroke fluid signals to the second pump 112 from port A of the valve 162. That is, the valve 160 effectively applies each separate pilot signal required for each stroking of the pump, while the valve 164 interrupts each fluid stroke signal after a predetermined time. The time delays in the valves 160 and 164 are preset such that the valve 164 interrupts the pilot signal at the end of each stroke of the second pump 112 and the valve 160 supplies the pilot signal again to the second pump 112 when the second pump 112 is ready to begin another stroke.

As each pilot signal is supplied to the second pump 112, the fluid counter 156 receives a fluid pulse at port Z through fluid line 170 and, therefore, records the given fluid stroke signal. When the number of stroke signals presented to the second pump 112 equals the aggregate number of pump strokes that have been preset into the counter 156, the counter 156 generates a fluid disconnect or termination signal from its port A. This disconnect signal is then presented via fluid line 174 to the swaging indicator 98 through the fluid disconnect line 16(*d*) and to pilot port Z of the valve 158, port X of the OR gate 152 and pilot port Z of the valve 166. Thus, the indicator 98 notifies the operator that the expansion process is complete. Since the pressurization of the working fluid has now ended, the tube 28 contracts somewhat and tightly grips the sleeve 26 so that a tight and substantially leakproof joint is formed between them.

The valve 158 also shifts in response to the disconnect signal, thereby preventing any fluid signal from being presented to port P of the valve 166 through port A of the AND gate 154. Similarly, the presence of a disconnect signal at pilot port Z of the valve 166 shifts the valve 166 such that fluid signals cannot be presented to port P of the valve 162 from port B of the valve 166. Concurrently, the OR gate 152 blocks any further supply of fluid signals from port A of the valve 160 to pilot port Z of the valve 162. Consequently, the second pump 112 is deactivated since it is not supplied with any further pilot or fluid stroke signals through fluid line 122.

The indicator 68 notifies the operator that the expansion process is complete. Therefore, the apparatus 10 can be turned off by releasing the button 100 of the operator control switch 94. When the button 100 is so released, the operator control switch 94 closes off any further supply of driving fluid from the fluid output line 16(*c*). Therefore, the first pump 110 and the release valve 166 stop receiving fluid signals. Accordingly, the first pump 110 deactivates and the release valve 176 opens so as to permit substantially all of the working fluid to be recycled to the tank 108 through the fluid return line 178. It will also be appreciated that the "one-shot" nature of the valve 168 further ensures that the control system 14 is deactivated, even though the operator may continue to depress the button 100 after the expansion process has concluded.

It will be observed that the components of the hydraulic fluid control circuit 114 that control the stroking of the first and second pumps 110 and 112 are operated by the same driving fluid source 20 that drives the first and second pumps 110 and 112 and the swaging assembly 12. Nevertheless, these components need not necessarily be required to carry the large volume of fluid that drives the first and second pumps 110 and 112 or the swaging assembly 12. Moreover, the entire apparatus 10 is preferably driven a by pneumatic source, has the reliability traditionally associated with pneumatic equipment and does not require any local electrical power supply. This is particularly beneficial in connection with applications in highly explosive environments where the presence of electrical equipment is normally undesirable.

Although the invention has been described in detail with reference to the presently preferred embodiment, it will be appreciated by those skilled in the art that various modifications can be made without departing from the spirit and scope of the invention. Accordingly, the scope of the present invention is not to be limited by the particular embodiments above but is to be defined only by the claims set forth below and equivalents thereof.

I claim:

1. An apparatus for radially expanding and anchoring a sleeve within a tube, which is contained within a bore in a surrounding structure having a primary side and a secondary side but extends axially beyond said secondary side of said structure, so as to repair a defective area of said tube and form a tight and substantially leakproof joint between said tube and sleeve, comprising:

a fluid source for supplying a first pressurized fluid and a second fluid;

a hydraulic expanding mandrel positioned axially within said sleeve, said mandrel having an elongated body with two axially separated seals, said mandrel and said sleeve together defining a substantially annular hydraulic pressure zone situated between said sleeve, said body and said seals with a certain portion of said pressure zone being situated beyond said secondary side, said mandrel being further connected to said fluid source and having a passage for conveying said second fluid to said pressure zone;

a first pump, which is linked to said fluid source and to said passage and pressurizes said second fluid upon being driven by said first fluid, said first pump further being preset so as to pressurize said second fluid and cause said second fluid to enter said pressure zone until said second fluid reaches a predetermined pressure which is above the radial yield point of said sleeve but below the aggregate radial yield point of said sleeve and tube, whereby said sleeve pre-expands into said tube substantially radially throughout said pressure zone;

a second pump, which is linked to said fluid source and said passage and pressurizes said second fluid upon being driven by said first fluid, said second pump being preset so as to pressurize said second fluid and cause a predetermined total volume of said second fluid to enter said pressure zone at a predetermined maximum pressure which is above said aggregate yield point, whereby said sleeve further expands substantially radially throughout said pressure zone and said tube expands substantially radially along with said sleeve; and fluid control means for selectively activating said second pump after said sleeve has substantially pre-expanded into said tube and for controlling the total volume of said second fluid passage by said second pump through application of fluid stroke signals to said second pump, said control means being linked to said fluid source and being driven by said first fluid.

2. An apparatus according to claim 1, wherein said fluid control means includes:

pilot switch means for sensing the pressure of said second fluid and for generating a pilot switch fluid signal when said first pump has pressurized said second fluid to a pressure which is above said radial yield point but below said aggregate yield point, said pilot switch means being linked to said fluid source driven by said first fluid;

logic means, responsive to said pilot switch fluid signal and, for selectively activating said second pump and controlling the stroking of said second pump by presenting said fluid stroke signals to said second pump after the pressure of said second fluid within said pressure zone is above said yield point but is below said aggregate yield point, said logic means being further linked to said fluid source and driven by said first fluid; and operator switch means, supplied by said first fluid and interactive with said first pump and said logic means, for selectively activating said first pump via generating an operator fluid signal that is presented to said first pump and for pre-pressurizing said control means by presenting said operator fluid signal to said logic means.

3. An apparatus according to claim 2, wherein said pilot switch means is preset so that it selectively activates when said pressure is midway between said yield point and said aggregate yield point.

4. An apparatus according to claim 2, wherein said fluid control means further includes fluid counter means, responsive to said fluid stroke signals and linked to said fluid source and driven by said first fluid, for counting the number of strokes of said second pump and comparing said number of strokes with a predetermined total number of expansion strokes and selectively deactivating said second pump via terminating said fluid stroke signals when said number of strokes equals said total number of expansion strokes.

5. An apparatus according to claim 2, wherein said apparatus further including release valve means, responsive to said operator fluid signal, for selectively recycling substantially all of said second fluid back to said fluid source upon termination of said operator fluid signal.

6. An apparatus according to claim 1, wherein said first and second pumps are of the pneumatically driven reciprocating type.

7. An apparatus for radially expanding and anchoring a sleeve within a tube, which is contained within a bore in a surrounding structure having a primary side and a secondary side but extends axially beyond said secondary side of said structure, so as to repair a defective area of said tube and form a tight and substantially leakproof joint between said tube and sleeve, comprising:

a fluid source for supplying a first pressurized fluid and a second fluid;

a hydraulic expanding mandrel positioned axially within said sleeve, said mandrel having an elongated body with two axially separated seals, said mandrel and said sleeve together defining a substantially annular hydraulic pressure zone situated between said sleeve, said body and said seals with a certain portion of said pressure zone being situated beyond said secondary side, said mandrel being further connected to said fluid source and having a passage for conveying said second fluid to said pressure zone;

a first pump, which is linked to said fluid source and to said passage and pressurizes said second fluid upon being driven by said first fluid, said first pump further being preset so as to pressurize said second fluid and cause said second fluid to enter said pressure zone until said second fluid reaches a predetermined pressure which is above the radial yield point of said sleeve but below the aggregate radial yield point of said sleeve and tube, whereby said sleeve pre-expands into said tube substantially radially throughout said pressure zone;

a second pump, which is linked to said fluid source and said passage and pressurizes said second fluid upon being driven by said first fluid, said second pump being preset so as to pressurize said second fluid and cause a predetermined total volume of said second fluid to enter said pressure zone at a predetermined maximum pressure which is above said aggregate yield point, whereby said sleeve further expands substantially radially throughout said pressure zone and said tube expands substantially radially along with said sleeve; and fluid control means for selectively activating said second pump after said sleeve has substantially pre-expanded into said tube and for controlling the total volume of said second fluid passage by said second pump through application of fluid stroke signals to said second pump, said control means being linked to said fluid source and being driven by said first fluid, said fluid control means including (a) pilot switch means for sensing the pressure of said second fluid and for generating a pilot switch fluid signal when said first pump has pressurized said second fluid to a pressure which is above said radial yield point but below said aggregate yield point, said pilot switch means being linked to said fluid source driven by said first fluid, (b) logic means, responsive to said pilot switch fluid signal and, for selectively activating said second pump and controlling the stroking of said second pump by presenting said fluid stroke signals to said second pump after the pressure of said second fluid within said pressure zone is above said yield point but is below said aggregate yield point, said logic means being further linked to said fluid source and driven by said first fluid, and (c) operator switch means, supplied by said first fluid and interactive with said first pump and said logic means, for selectively activating said first pump via generating an operator fluid signal that is presented to said first pump and for prepressurizing said control means by presenting said operator fluid signal to said logic means.

8. An apparatus according to claim 7, wherein said pilot switch means is preset so that it selectively activates when said pressure is midway between said yield point and said aggregate yield point.

9. An apparatus according to claim 7, wherein said fluid control means further includes fluid counter means, responsive to said fluid stroke signals and linked to said fluid source and driven by said first fluid, for counting the number of strokes of said second pump and comparing said number of strokes with a predetermined total number of expansion strokes and selectively deactivating said second pump via terminating said fluid stroke signals when said number of strokes equals said total number of expansion strokes.

10. An apparatus according to claim 7, wherein said apparatus further including release valve means, responsive to said operator fluid signal, for selectively recycling substantially all of said second fluid back to said fluid source upon termination of said operator fluid signal.

11. An apparatus according to claim 7, wherein said first and second pumps are of the pneumatically driven reciprocating type.

12. An apparatus for radially expanding and anchoring a sleeve within a tube, which is contained within a bore in a surrounding structure having a primary side and a secondary side but extends axially beyond said secondary side of said structure, so as to repair a defective area of said tube and form a tight and substantially leakproof joint between said tube and sleeve, comprising:

a fluid source for supplying a first pressurized fluid and a second fluid;

a hydraulic expanding mandrel positioned axially within said sleeve, said mandrel having an elongated body with two axially separated seals, said mandrel and said sleeve together defining a substantially annular hydraulic pressure zone situated between said sleeve, said body and said seals with a certain portion of said pressure zone being situated beyond said secondary side, said mandrel being further connected to said fluid source and having a passage for conveying said second fluid to said pressure zone;

a first pump, which is linked to said fluid source and to said passage and pressurizes said second fluid upon being driven by said first fluid, said first pump further being preset so as to pressurize said second fluid and cause said second fluid to enter said pressure zone until said second fluid reaches a predetermined pressure which is above the radial yield point of said sleeve but below the aggregate radial yield point of said sleeve and tube, whereby said sleeve pre-expands into said tube substantially radially throughout said pressure zone;

a second pump, which is linked to said fluid source and said passage and pressurizes said second fluid upon being driven by said first fluid, said second pump being preset so as to pressurize said second fluid and cause a predetermined total volume of said second fluid to enter said pressure zone at a predetermined maximum pressure which is above said aggregate yield point, whereby said sleeve further expands substantially radially throughout said pressure zone and said tube expands substantially radially along with said sleeve; and fluid control means for selectively activating said second pump after said sleeve has substantially pre-expanded into said tube and for controlling the total volume of said second fluid passage by said second pump through application of fluid stroke signals to said second pump, said control means being linked to said fluid source and being driven by said first fluid, said fluid control means including (a) pilot switch means for sensing the pressure of said second fluid and for generating a pilot switch fluid signal when said first pump has pressurized said second fluid to a pressure which is above said radial yield point but below said aggregate yield point, said pilot switch means being linked to said fluid source driven by said first fluid, (b) logic means, responsive to said pilot switch fluid signal and, for selectively activating said second pump and controlling the stroking of said second pump by presenting said fluid stroke signals to said second pump after the pressure of said second fluid within said pressure zone is above said yield point but is below said aggregate yield point, said logic means being further linked to said fluid source and driven by said first fluid, (c) operator switch means, supplied by said first fluid and interactive with said first pump and said logic means, for selectively activating said first pump via generating an operator fluid signal that is presented to said first pump and for pre-pressurizing said control means by presenting said operator fluid signal to said logic means, and (d) fluid counter means, responsive to said fluid stroke signals and linked to said fluid source and driven by said first fluid, for counting the number of strokes of said second pump and comparing said number of strokes with a predetermined total number of expansion strokes and selectively deactivating said second pump via terminating said fluid stroke signals when said number of strokes equals said total number of expansion strokes.

13. An apparatus according to claim 12, wherein said pilot switch means is preset so that it selectively activates when said pressure is midway between said yield point and said aggregate yield point.

14. An apparatus according to claim 12, wherein said apparatus further including release valve means, responsive to said operator fluid signal, for selectively recycling substantially all of said second fluid back to said fluid source upon termination of said operator fluid signal.

15. An apparatus according to claim 12, wherein said first and second pumps are of the pneumatically driven reciprocating type.

* * * * *